US008590262B1

(12) United States Patent
Fluga

(10) Patent No.: US 8,590,262 B1
(45) Date of Patent: Nov. 26, 2013

(54) ENERGY EFFICIENT BUILDING CONSTRUCTION

(75) Inventor: Mark A. Fluga, Manistee, MI (US)

(73) Assignee: EnergySmart Building Method, LLC, Marquette, MI (US)

( * ) Notice: Subject to any disclaimer, the term of this patent is extended or adjusted under 35 U.S.C. 154(b) by 383 days.

(21) Appl. No.: 12/855,158

(22) Filed: Aug. 12, 2010

Related U.S. Application Data

(60) Provisional application No. 61/233,913, filed on Aug. 14, 2009.

(51) Int. Cl.
*E04G 1/00* (2006.01)
*E04G 21/00* (2006.01)
*E04G 23/00* (2006.01)

(52) U.S. Cl.
USPC ..... 52/745.05; 52/741.1; 52/373; 52/745.02; 52/745.19; 52/677; 52/238.1; 52/243

(58) Field of Classification Search
USPC ..... 52/79.1, 309.4, 383, 380, 220.2, 741.1, 52/745.1, 745.02, 745.05, 742.13, 745.19, 52/677, 238.1, 243
See application file for complete search history.

(56) References Cited

U.S. PATENT DOCUMENTS

| | | | | |
|---|---|---|---|---|
| 1,096,773 | A | 5/1914 | Vernon | |
| 2,467,115 | A * | 4/1949 | Duggan | 52/699 |
| 3,305,993 | A | 2/1967 | Nelsson | |
| 3,381,429 | A | 5/1968 | Rich | |
| 3,727,753 | A * | 4/1973 | Starr et al. | 206/321 |
| 3,949,532 | A * | 4/1976 | Jonsson et al. | 52/404.1 |
| 3,969,860 | A | 7/1976 | Bentley | |
| 4,114,345 | A | 9/1978 | Nilsen | |
| 4,237,865 | A | 12/1980 | Lorenz | |
| 4,317,443 | A | 3/1982 | Hayama | |
| 4,420,036 | A | 12/1983 | Blaser | |
| 4,471,591 | A | 9/1984 | Jamison | |
| 4,615,155 | A * | 10/1986 | Chamberlain | 52/91.1 |
| 4,669,240 | A * | 6/1987 | Amormino | 52/236.6 |
| 5,634,315 | A | 6/1997 | Toya | |
| 5,782,048 | A * | 7/1998 | Ramirez | 52/295 |
| 5,927,043 | A * | 7/1999 | Newkirk | 52/742.14 |
| 6,269,607 | B1 | 8/2001 | Ringlein et al. | |
| 7,640,700 | B2 * | 1/2010 | Starke | 52/220.2 |

* cited by examiner

*Primary Examiner* — Chi Q Nguyen
(74) *Attorney, Agent, or Firm* — Gardner, Linn, Burkhart & Flory, LLP

(57) ABSTRACT

A cost-effective and energy-efficient system and method for building construction, such as for residential dwellings and the like, uses dual-wall building envelope system having outer walls and corresponding partition walls spaced outwardly from the outer walls. The envelope system provides ample space for insulation to enhance the thermal efficiently of the house or building, while permitting construction at reduced cost using pre-fabrication methods.

17 Claims, 4 Drawing Sheets

ENERGY EFFICIENT BUILDING CONSTRUCTION

CROSS-REFERENCE TO RELATED APPLICATION

The present application claims the benefit of U.S. provisional application Ser. No. 61/233,913, filed Aug. 14, 2009, which is hereby incorporated herein by reference in its entirety.

FIELD OF INVENTION

The present invention relates generally to building structures and methods of building, and specifically to building structures and methods for building energy-efficient structures.

BACKGROUND OF THE INVENTION

Typical methods of new construction for building single-family homes, multi-family homes and commercial buildings are either not energy efficient or too costly for an average buyer after adding on the necessary components to make them energy efficient. The current standards for new conventional construction result in buildings that are not energy efficient and therefore use significant amounts of energy to heat and cool the buildings, which results in increased greenhouse gas emissions nationwide. The energy efficiency of a building can be significantly impacted by using higher energy efficiency materials and better energy efficient building designs, higher technology appliances with computer controlled energy management systems and solar and wind power devices, but they come with a significant additional cost, which can prohibit a typical homebuyer from purchasing an energy efficient home.

One challenge of existing methods of new building construction and adding energy efficiency is the significant added cost that prohibits the typical homebuyer from purchasing an energy efficient home. This is such a critical issue for the United States that the U.S. Department of Energy (D.O.E.) has offered a federal grant of $129 million (FY2010 Energy Efficient Building Systems Regional Innovation Cluster Initiative; Funding Opportunity Number ERIC2010) to a consortium of manufacturers, research laboratories, small business and universities that can demonstrate the potential to design and make available to people in the U.S. by the year 2030 a cost-neutral, net-zero energy house.

The U.S. Department of Energy, Energy Efficiency & Renewable Energy Div., Building Technologies Program states: "The DOE's ultimate vision is that, by 2030, a consumer will have the opportunity to buy a cost-neutral, net-zero energy home (NZEH) anywhere in the United States—a grid-connected home that, over the course of a year, produces as much energy as it uses" (http://www1.eere.energy.gov/buildings/challenge/about.html). That means the desired house costs no more than a standard site-built house, but is energy efficient to the point that the house produces as much energy as it consumes and so there is no utility cost to the homeowner who buys one. This further would result in a significant reduction in green gas emissions and ultimately the carbon footprint left by this country. The fact that the D.O.E. is offering $129 million to develop a cost-neutral, net-zero energy house is indicative that this goal had not yet been achieved.

The building of 65,000 net-zero energy homes per year, for example, could have significant and far reaching effects on our environment, potentially eliminating 2.8 million metric tons of carbon emissions into the atmosphere over a twenty year period, would save homeowners $1.7 billion in utility costs, take the equivalent of 606,000 cars off the road, generate cumulative energy savings of 0.178 quads (primary), contribute significantly to the greenhouse gas emissions reduction goal of 83% by mid-century, could eliminate or obviate the need for seventy-nine 500-Megawatt power plants, and significantly reduce our dependency on foreign oil (see http://www1.eere.energy.gov/buildings/challenge/energysmart.html). The economy may also benefit as home builders and home buyers realize there is an immediate benefit to buying a cost-neutral, net-zero energy house (as compared to not buying any new house), which may increase employment in all markets and disciplines that support new home construction as the sales of such homes increase.

SUMMARY OF THE INVENTION

The present invention provides a cost-effective and energy-efficient system and method for building construction, such as for residential dwellings and the like. The building construction of the present invention uses a manufactured interior with exterior partition walls creating an energy efficient envelope system that may be combined with one or more of: spray foam insulation, solar and/or wind energy devices, energy efficient building materials and appliances, and other energy efficient components. The resulting buildings may be operated (heating, cooling, lighting, electricity, and other energy needs) at substantial savings over conventionally constructed buildings, so that increased construction costs (compared to the cost of constructing conventional inefficient buildings) are offset, or more than offset, with operating savings. In addition, the resulting buildings may produce approximately the same amount of energy that they consume throughout a year, so that annual energy costs are approximately zero, although it will be appreciated that individual buildings may produce more or less energy than they consume, depending on their usage and the availability of non-grid energy.

The present invention can overcome the obstacles to distribution inherent in other net-zero energy homes. For example, there are approximately 65,000 National Association of Home Builders members that build 80% of the new homes. To achieve its goals, the federal government and D.O.E. would have to convince most of them to add $45,000 to $75,000 to the cost of the homes they build, and then convince consumers that it is worth the extra down payment and higher mortgage payments to own one. In contrast, new homes could be built in accordance with the present invention by the manufactured housing industry (MHI), which is currently made up of 5 to 7 main companies with current open capacity to start building such homes. These sales would primarily be taken from the conventional site-built market and would permit the MHI to compete with site-built builders for the same homebuyers.

According to one form of the present invention, a building construction is provided for producing a building with improved energy efficiency. The building construction includes a foundation, a plurality of at least partially prefabricated outer walls, a plurality of at least partially prefabricated partition walls, a plurality of brackets coupled between the outer walls and the partition walls, a roof assembly, and an insulation material. The outer walls define an interior a living area, and are supported at the foundation. The partition walls correspond to the outer walls and are also supported at the foundation. The partition walls are positioned outwardly of and substantially parallel to the outer walls, so that the partition walls substantially surround the outer walls with spaces defined between the outer walls and the partition walls. The roof assembly is positioned atop the outer walls and the partition walls, and is supported by at least one of the outer walls and the partition walls. The insulation material substantially fills the spaces between the outer walls and the partition walls, and fills at least a portion of the roof assembly.

In one aspect, the building construction includes a flooring structure positioned atop the foundation so that the outer walls are positioned between the flooring structure and the roof structure. Optionally, the partition walls are coupled directly to the foundation using a plurality of mechanical fasteners, such as bolt anchors or the like, that engage the foundation.

In another aspect, the insulation material is a spray foam insulation that fills the spaces between the outer walls and the partition walls, and that also fills spaces within the outer walls and the partition walls. The spray foam insulation may adhere to and seal with the outer walls, the partition walls, the foundation, and at least a portion of the roof assembly, and may cure in a manner that enhances the structural strength and fire resistance of at least the outer walls and the partition walls.

In yet another aspect, the partition walls further include sheathing material and exterior siding. The sheathing material and the exterior siding form outer surfaces of the partition wails. Optionally, the outer walls further include drywall which forms inwardly-facing surfaces of the outer walls. Optionally, the outer walls may include plumbing and electrical wiring.

In still another aspect, at least some of the outer walls and the partition walls are prefabricated with window openings and/or door openings. The window openings or door openings of the outer walls substantially align with corresponding window openings or door openings of the partition walls.

In a further aspect, the foundation has a first thickness below the outer walls, and has a second thickness below the partition walls. The first thickness is greater than the second thickness, which provides sufficient strength when the outer walls are load bearing walls that support the roof assembly, while the partition walls may be non load bearing.

In a still further aspect, the building construction includes an at least partially pre-fabricated building interior that is made up of one or more of: (i) at least one interior wall, (ii) carpeting, (iii) cabinetry, (iv) an electrical fixture, and (v) a plumbing fixture.

According to another form of the present invention, a method is provided for constructing an improved energy efficiency building. The method includes pre-fabricating a plurality of outer walls, a plurality of partition walls, and a roof assembly. Each of the outer walls and the partition walls is pre-fabricated to include a plurality of generally vertically aligned studs, a footer, and a top plate, while the roof assembly is pre-fabricated to include a plurality of roof trusses. Also provided are an insulation material and a foundation at a building site. The method further includes transporting the outer walls, the partition walls, the roof assembly, and the insulation material to the building site. The outer walls are positioned so that they are supported by the foundation, but spaced inwardly from an outer perimeter region of the foundation, so that the outer walls define an inner living area of the building. The partition walls are positioned outwardly from the outer walls so that the partition walls are supported at the outer perimeter region of the foundation and form spaces between the outer walls and the partition walls. The partition walls are coupled to respective outer walls using a plurality of brackets that span between the outer walls and the partition walls. The spaces between the outer walls and the partition walls are substantially filled with the insulation material. The roof assembly is positioned atop the outer walls, and at least a lower portion of the roof assembly is filled with the insulation material.

Optionally, the outer walls, the roof assembly, and the floor assembly are pre-assembled and transported to the building site as a pre-assembled building portion.

Thus, the building construction and method of the present invention provide a highly thermally efficient building, such as a house or other dwelling, or a commercial building, using pre-fabricated components, which is cost-competitive with conventionally constructed buildings. The building construction utilizes a dual-wall system and full-coverage insulation to achieve high degrees of thermal efficiency, while realizing cost savings through pre-fabrication techniques.

These and other objects, advantages, purposes, and features of the present invention will become apparent upon review of the following specification in conjunction with the drawings.

DESCRIPTION OF THE PREFERRED EMBODIMENTS

Figure 2:
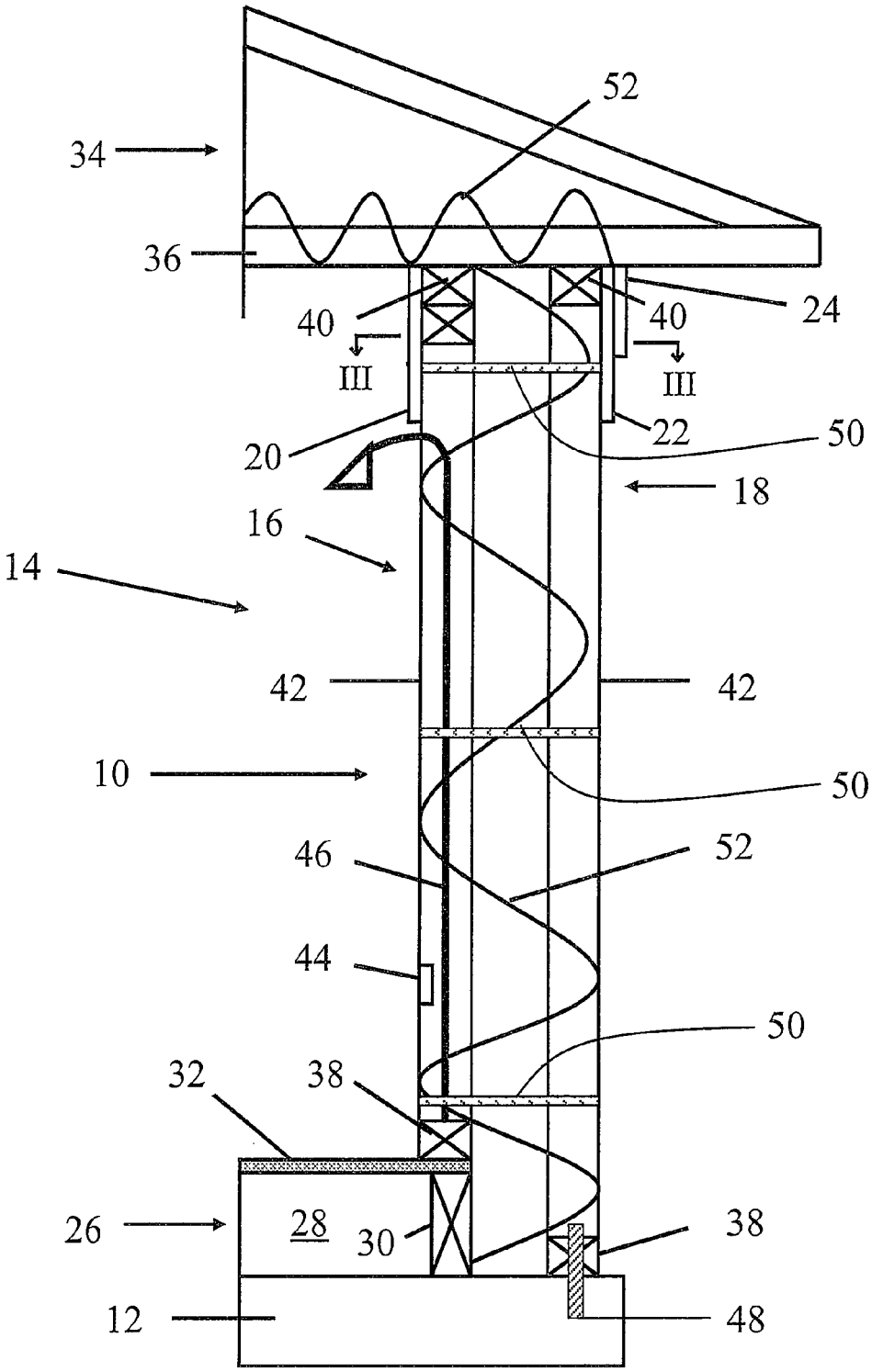
FIG. 2 is another side sectional elevation of the perspective view of the portion of the manufactured house of FIG. 1, shown with the partition wall installed.
Figure 3:
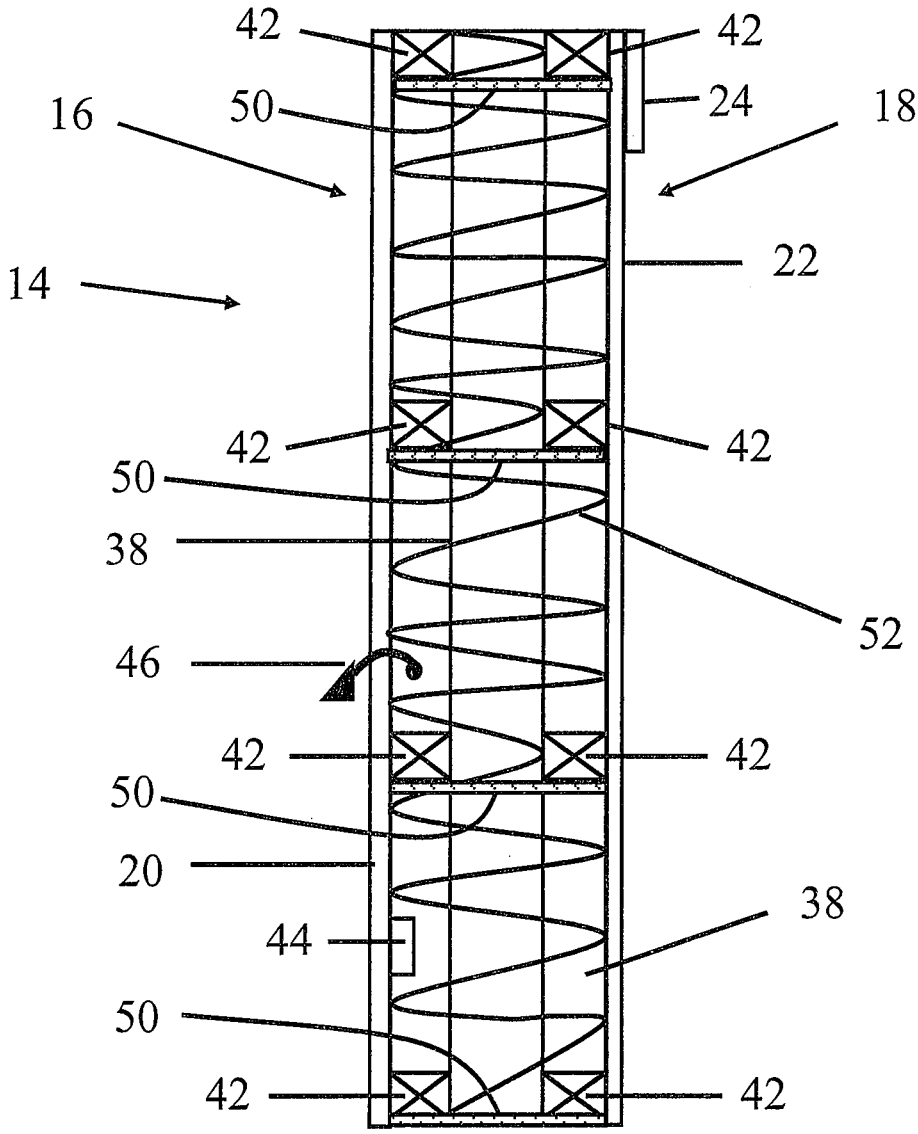
FIG. 3 is a top sectional view taken along line in FIG. 2.
Figure 4:
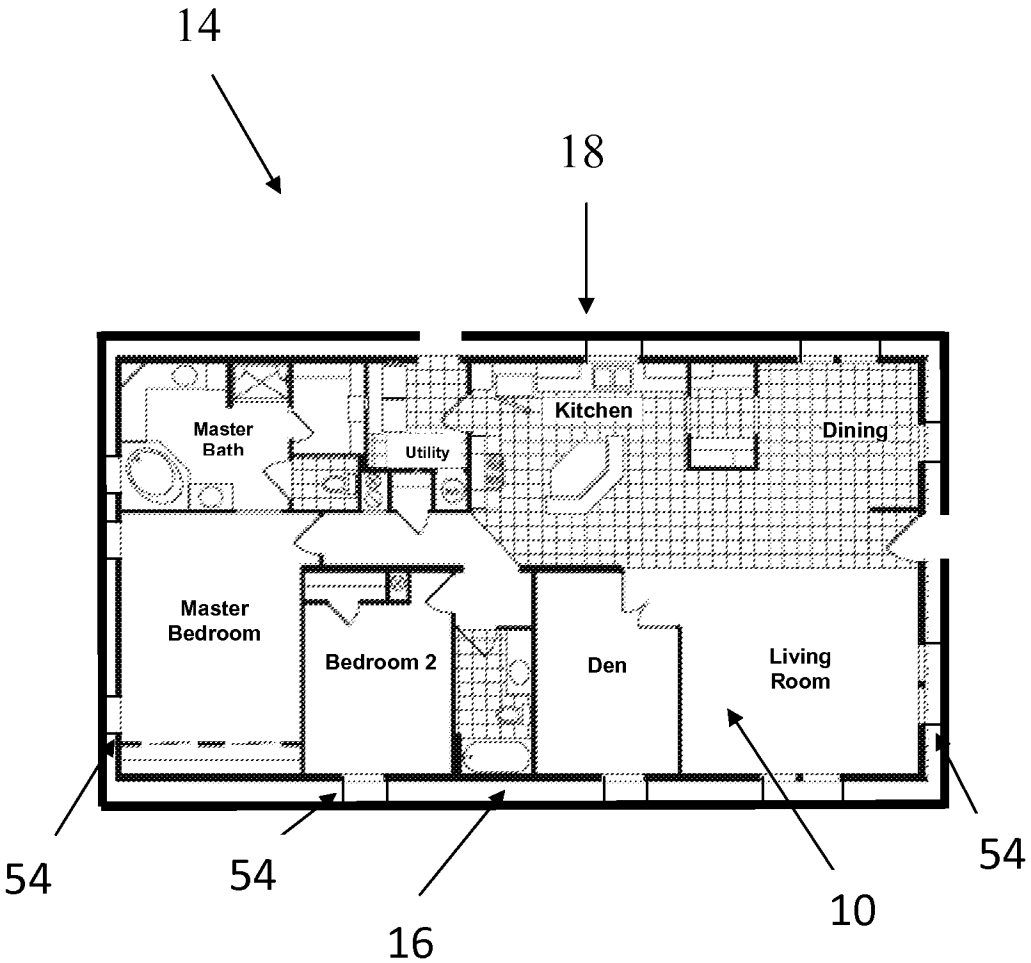
FIG. 4 is a section top plan view of a manufactured house incorporating a building envelope system of the present invention.

Referring now to the drawings and the illustrative embodiments depicted therein, in a preferred embodiment a free-standing modular or manufactured house 10 is supported on a foundation 12 and provides a dual-wall building envelope system 14 having outer walls 16 and corresponding partition walls 18 spaced outwardly from the outer walls 16 (FIGS. 2-4). The envelope system 14 provides ample space for insulation to enhance the thermal efficiently of the house or building, while permitting construction of energy-efficient buildings at reduced cost using pre-fabrication methods. It will be appreciated that although the invention is primarily described with reference to a free-standing residential home, the invention can be applied to apartment buildings, condominium buildings, commercial buildings, or substantially any structure in which thermal insulation is desirable.

Figure 1:
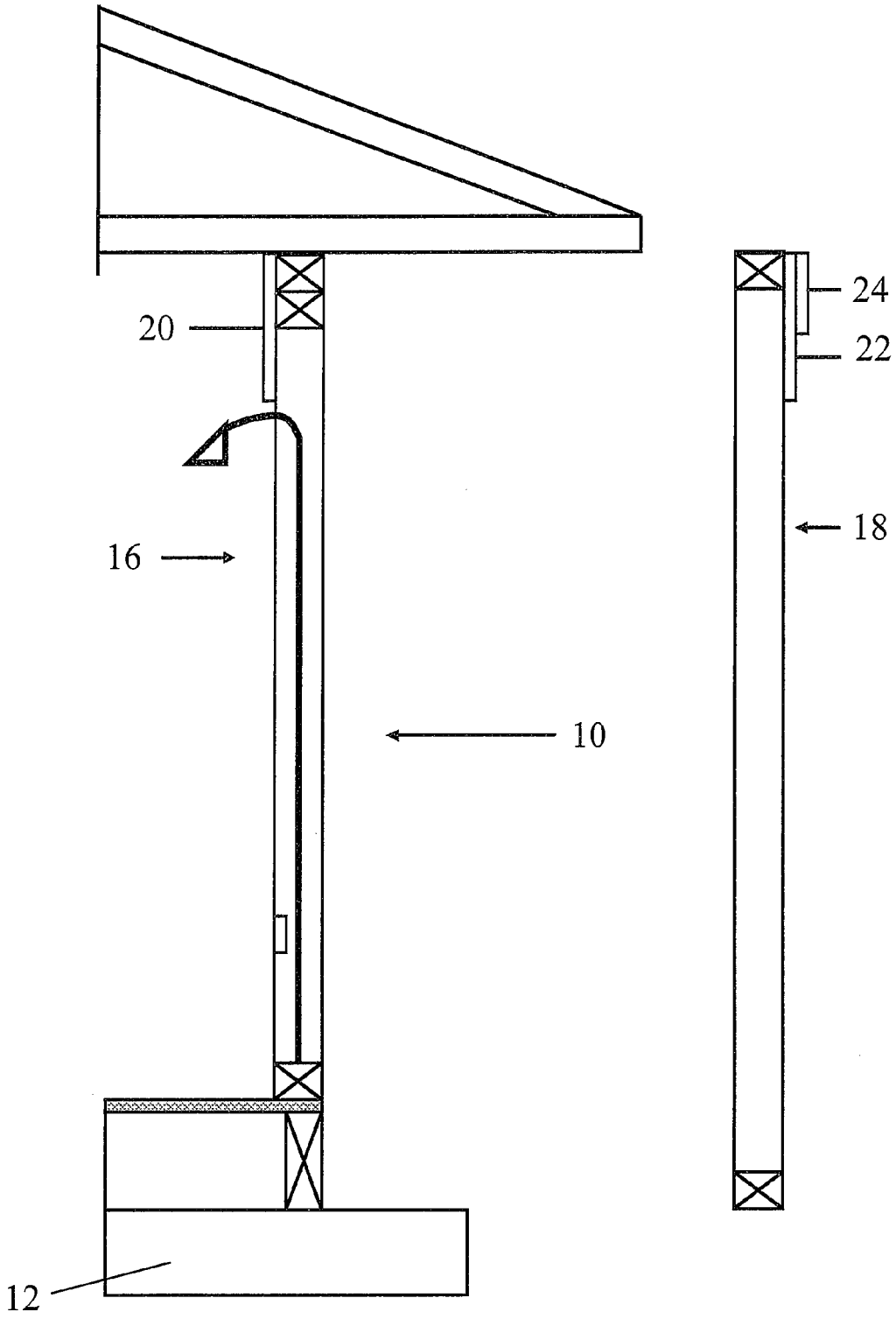
FIG. 1 is a partially-exploded side sectional elevation of a portion of a manufactured house incorporating a building envelope system having a partition wall in accordance with the present invention.

The manufactured house's outer walls 16 have drywall 20 affixed to the occupant side of the outer walls 16 (FIGS. 1 and 2). In FIG. 1, outer wall 16 is shown with no insulation, sheathing, siding, windows, doors, or vapor barrier attached. A prefabricated or manufactured or otherwise constructed partition wall 18 includes a sheathing 22 and a siding 24 affixed to the exterior side or surface of the partition wall 18 which, in the illustrated embodiment, has no insulation prior to installation (FIG. 1). For clarity, only small portions of siding 24, drywall 20, and sheathing 22 are shown in FIGS. 1-3.

Once partition wall 18 is installed to form a building envelope system 14 (FIGS. 2-4), the house outer wall 16 and partition wall 18 cooperate to form a double wall in which the partition wall 18 is the exterior wall of a manufactured house 10, while the house outer wall 16 effectively becomes the interior wall structure of the manufactured house 10, to create an enclosed space between the two walls 16, 18. The manufactured house 10 may be constructed of standard materials and processes, such as one utilizing a 2×4 frame of the outer wall 16 of the manufactured house 10 seated on a flooring structure 26. Flooring structure 26 includes joists 28, stringers 30, and a floor covering 32 (FIG. 2).

The 2×4 frame partition wall 18 is constructed of standard materials and processes, is supported on a foundation 12, such as a cement foundation at a building site, and extends up to a roof structure assembly 34 made up of roof trusses 36 (FIG. 2). Partition wall 18 may be pre-fabricated to include pre-installed windows and doors installed in openings in the wall. The manufactured house's outer wall 16 includes a footer 38, a top plate 40, and spaced upright studs 42 (such as 2×4 or 2×6 studs or the like), along an outer edge portion of the flooring structure 26. The outer walls 16 and partition walls 18 include window and door openings that align with one another so that windows and doors that are pre-installed in partition walls 18 will align with the window and door openings in the outer walls 16, once the partition walls 18 are erected. It will be appreciated that windows and doors may be installed in respective openings in the outer walls 16, instead of or in addition to windows installed in the partition walls. Thus, doors and/or windows may be pre-installed in openings in the outer walls 16 (or installed after the manufactured house 10 with outer walls 16 is moved to the building site), or doors and/or windows may be pre-installed in openings in the partition walls 18 (or installed after the partition walls 18 are moved to the building site), or doors and/or windows may be installed in both the outer walls 16 and the partition walls 18, such as to provide added insulation and soundproofing at the window and door openings of the house 10.

Electrical wiring 44 and plumbing 46 may be run within the outer wall 16, with drywall 20 affixed to the occupant side of the studs 42. The partition wall 18 includes a footer 38, a top plate 40, and spaced upright studs 42 along an outer edge portion of the foundation 12, parallel to and spaced from the outer wall 16. Partition wall 18 carries sheathing 22 and siding 24 in a substantially conventional manner. The partition wall 18 is fastened to the foundation 12 along the length of the footer 38 by bolt anchors 48 (FIG. 2), while the walls 16, 18 are strengthened and spaced or cross-braced by brackets 50 that are affixed to the studs 42 of both the outer wall 16 and the partition wall 18 studs 42. In the illustrated embodiment, the brackets are attached near the top, middle, and bottom of each opposing stud 42 (of the respective walls 16, 18) along the length of the walls, or in other combinations as may be desired or required by building codes. The brackets can be wood, steel, aluminum, composite, or any number of other materials that would be approved under the building codes for this use. In the illustrated embodiment, the outer wall 16 and the partition wall 18 are constructed with their respective studs 42 in the same general arrangement, such as on 16-inch centers, so that the brackets 50 can be readily attached to opposite and opposed studs 42 of the respective walls 16, 18.

In the illustrated embodiment, the outer wall 16 is a load bearing wall and the top plate 40 on the outer wall 16 comprises a double plate for strength and rigidity. The load bearing outer wall 16 may also be constructed of conventional 2×4 studs 42 on 16-inch centers (i.e. spaced approximately 16 inches apart), although it will be appreciated that other wall construction methods may be used without departing from the spirit and scope of the present invention. For example, it is envisioned that 2×6 studs or metal or composite studs of varying dimensions may be used. The outer wall 16 and the partition wall 18 can alternatively be constructed of steel, aluminum, composite material, or molded in fiberglass as a single panel, for example. Outer wall 16 supports roof assembly 34 including trusses 36, and has electrical wiring 44 and plumbing 46 installed throughout. The partition wall 18 may similarly be constructed of 2×4 studs 42 on 16-inch centers, or may be constructed using other methods and/or materials.

Spray foam insulation 52 may be used to fill the space between the outer wall 16 and partition wall 18 and between all studs 42 and from the foundation 12 up to and through the trusses 36. Adhesive-type spray foam insulation 52 may be used to coat every square inch of all surfaces touched, in order to maximize the insulation value of the enclosed space between walls 16, 18 (FIGS. 2 and 3). The spray foam insulation 52 may also be used in the roof area above the ceiling in the roof assembly 34, filling all areas between the trusses 36 and to a desired depth above the trusses 36, across the entire ceiling area. Along the edges of the ceiling area in the roof assembly 34 there may be a continuous layer of spray foam insulation 52 from the foundation 12 and up through the trusses 36. Where the spray foam insulation 52 from each application meets (e.g. where the spray foam in the roof assembly 34 meets the spray foam between the walls 16, 18), the spray foam forms an adhesive, insulating, and impermeable bond.

Because of its adhesive and hardening properties, the spray foam insulation 52, once cured to a rigid or semi-rigid foam, can significantly enhance the structural strength, sealing, and fire-resistant properties of the building envelope system 14 by forming a solid-core wall of foam (such as one having fire-retardant properties) that surrounds the house within the walls and covers the roof trusses 36 and ceiling, acting as an adhesive and bonding it all together.

One suitable spray insulation is STYROFOAM° brand Spray Polyurethane Foam (SPF), available from Dow Chemical Company of Midland, Mich. It has been found that about 8 inches of space between the drywall 20 on the outer wall 16 and the sheathing 22 on the partition wall 18 provides the appropriate thickness of insulation to achieve an R-value of 48 when STYROFOAM® brand SPF is used. The spray foam insulation 52 specifications can be altered to enhance certain features, such as safety characteristics (e.g. fireproofing) and sound barrier, or to alter the thickness and density of the foam or any other insulation, to meet other requirements as may be desired. Although spray foam insulation 52 has numerous advantages and benefits such as those described above, it will be appreciated that other types of insulation, such as any insulation approved for use in residential construction of new site-built homes or modular and manufactured homes, may be used without departing from the spirit and scope of the present invention. For example, blown-in cellulose insulation may be applied in a similar manner as spray foam insulation 52, although it lacks the bonding ability of spray foam, and may move or sag or compact over time. Conventional spun fiberglass batting may also be used, although its application may be more difficult and time consuming, and it may not reach all of the areas that are desired to receive insulation.

The manufactured house 10 and/or its individual walls 16, 18 may be strengthened by straps or other forms of reinforcement on a diagonal pattern or other engineered acceptable practice across the outer wall 16 and/or partition wall 18 to maintain the integrity of the wall structure as it is transported to a building site. Once the manufactured house 10 is finished and the structural supports have been added, it can be moved to a building site and placed on the foundation 12 in substantially the same manner as any other modular or manufactured house.

The foundation 12 is sized to accommodate the manufactured house 10, including the partition wall 18 that is spaced outwardly from outer wall 16. It will be appreciated that the outside edge of the foundation 12, which supports only the partition wall 18, does not have to be as thick as the rest of the foundation 12 supporting the manufactured house 10 since, in the illustrated embodiment, the partition wall 18 is not a load bearing wall. However, the foundation's outside edge can be as thick as the rest of the foundation 12, if desired. The foundation 12 may be about 9 inches wider and about 9 inches longer than that required for just the outer walls 16 of the manufactured house 10, to allow for the partition walls 18 on all sides of the house to be spaced outwardly from outer walls 16 by about 9 inches. In this case, it may also be desirable to adjust the dimensions of roof trusses 36 in a corresponding manner. However, different insulation types and brands and specified uses may require substantially any distance or added dimensions to the width and length of the foundation 12 to accommodate the outer perimeter formed by partition walls 18. For example, depending on the insulation value desired and/or the type and efficiency insulation material used, the width of the space between the outer wall 16 and partition wall 18 may be varied from 0-15 inches. It will be appreciated that a spacing of 0 inches, for walls made up of 2×4 studs, would correspond to a fillable spacing of about 7.5 to 8 inches for insulation between the walls. Other factors that can affect desired width of the space between the outer wall 16 and partition wall 18 may include, for example, the construction method of the partition wall 18, the features that are desired such as energy efficiency, tornado safety, fire safety, flood prevention, and/or noise reduction.

The walls and other components of the manufactured house 10 can be pre-fabricated in a manufacturing facility separate and apart from the building site(s) of the houses or other structures that will be built from the components. For example, there are currently about 174 manufacturing facilities across the U.S., owned by companies already in the manufactured housing industry using standard materials and processes. The manufactured house 10 may be substantially finished in the manufacturing facility to the point it is ready to be moved to the building site, where final assembly takes place and sheathing, siding, windows, doors, and insulation are installed or added.

The partition wall 18 may be manufactured in the same facilities as the other components of the manufactured house 10, or can be built at the building site by conventional construction techniques, or built by any manner of construction and with any materials that result in a wall suitable for use as the exterior wall of a house and capable of being approved for use under all local, regional, and federal building codes.

The building method of the modular or manufactured house 10 in accordance with the present invention is generally as follows. The outer walls 16 of the manufactured house 10 are prefabricated or constructed with the footer 38, the top plate 40, and spaced upright studs 42 (and, optionally, windows and/or doors) in a manufacturing facility some distance away from the building site. Typically or optionally, each outer wall 16 is joined to at least one other outer wall 16, is further joined to a portion of the flooring structure 16 (to which pre-fabricated interior components, such as interior walls, carpeting, cabinetry, fixtures, etc. may be attached), and is also joined to a portion of the roof assembly 34, all of which accomplished in the manufacturing facility to form a pre-assembled building portion. The outer walls 16 (and any of the other parts to which they are pre-attached at the manufacturing facility, such as to form the aforementioned pre-assembled building portion) are transported to the building site, if necessary, and are erected or positioned atop the foundation 12. It will be appreciated that pre-fabricated portions or sections (e.g. pre-assembled building portions) of the house 10 may be transported separately and then mechanically joined at the build site. Electrical wiring 44 and plumbing 46 are installed within the outer walls 16, and drywall 20 is affixed to the occupant side of the studs 42 of outer walls 16, which may be accomplished as part of the pre-fabrication process at the manufacturing facility, or may be accomplished at the build site.

The partition walls 18 are pre-fabricated or constructed with the footer 38, the top plate 40, and spaced upright studs 42, typically at a manufacturing facility. The partition walls 18 may also be pre-fabricated at the manufacturing facility to include sheathing 12 and siding 24 along outer surfaces of the studs 42, and windows and/or doors may be added as well, or these components may be added later at the building site. The partition walls 18 are moved to the building site, if necessary, and are positioned along an outer edge portion of the foundation 12, parallel to and spaced from the outer walls 16. The partition walls 18 are fastened to the cement foundation 12 along the lengths of the footers 38 by bolt anchors 48 or any other generally acceptable method.

The two walls 16, 18 are strengthened and held in evenly-spaced (i.e. parallel) arrangement by brackets 50 that are affixed to the studs 42 of both the outer wall 16 and partition wall 18. The roof assembly 34 is then installed atop the walls 16, 18 (or just atop outer walls 16, if accomplished during a pre-assembly step) and, in the illustrated embodiment, is primarily supported by the outer walls 16. If the roof assembly 34 was not pre-installed atop the outer walls 16 at the manufacturing facility, the roof assembly 34 may be installed atop the outer walls 16 either prior to or after installation of the partition walls 18. Thus, in the illustrated embodiment, outer walls 16 are load bearing walls while partition walls 18 are not. However, it will be appreciated that partition walls 18 could be fully or partially load bearing, if desired.

Portals 54 typically are installed between corresponding window openings and door openings in outer walls 16 and partition walls 18, particularly if the spacing between outer wall 16 and partition wall 18 is such that framed window openings and door openings in the walls are spaced with gaps between the framing of the respective walls 16, 18 (FIG. 4). Alternatively, the portals 54 may be pre-installed on either of the outer walls 16 or the partition walls 18, and aligned with the window and door openings of the other outer walls 16 or the partition walls 18 once both sets of walls 16, 18 are erected. The portals 54 are typically rectangular elements or structures conforming to the inner dimensions of the window openings and door openings, and bridge between the outer walls 16 and partition walls 18 at respective window openings and door openings to present a finished appearance, and to prevent insulation from entering the window and door openings. To enhance the thermal efficiency of the windows, insulated shades can be installed along the interior side of the windows for use at night or during periods of non-use. The shades could be mounted in tracks along the window framing so that the shades are guided from extended to retracted positions.

Once the partition walls 18 are erected around the outer walls 16 and the window and door portals 54 are installed, windows and doors may be installed in the partition wall 18 and/or in the outer wall 16 if they were not already pre-installed during pre-fabrication at the manufacturing facility.

For example, it may be desirable to position windows in both the partition wall 18 and the outer wall 16, to take advantage of the extra insulating properties of an increased air space between the windows due to the spacing of the partition wall 18 from the outer wall 16. Once the partition walls are erected, the sheathing 22 and siding 24 may be installed along the outside of the studs 42 forming the partition wall 18, if these components were not pre-installed at the manufacturing facility.

The spray foam insulation 52 is sprayed between the outer walls 16 and the partition walls 18 to fill the spaces between the outer walls 16 and partition walls 18 and between all studs 42, and from the foundation 12 up to and through the trusses 36, coating all surfaces with adhesive-type spray foam insulation 52. The spray foam insulation 52 is also applied in the roof area above the ceiling in the roof assembly 34, filling all areas between the trusses 36 to a desired depth above the trusses 36, across the entire ceiling area. Along the edges of the ceiling area in the roof assembly 34 and where the spray foam insulation 52 was applied from the foundation 12, and up through the trusses 36, and where the spray foam insulation 52 from each application meets, they form a adhesive and insulating and impermeable bond. Accordingly, the building envelope system 14 may be applied in the construction of all outer walls of a manufactured house 10 (FIG. 4), or in other building structures in which energy efficiency is highly desirable, to provide exceptional insulation value at minimal extra cost.

Numerous benefits may be realized by constructing buildings, such as residential houses or other structures, in accordance with the present invention, of which the following are exemplary:

The use of a manufactured interior with partition walls creates an energy efficient envelope system than can reduce the cost of what would otherwise be a $150,000 conventional site-built house, by about 20% to 25%, while using equivalent grade materials.

The cost savings can be used to add energy efficient building materials and appliances and renewable energy devices such as solar and wind power for electrical generation, high tech spray foam insulation, geo-thermal heating and cooling units, energy efficient appliances, electrical, plumbing fixtures, building materials, LED lighting products, furniture and landscaping services.

The building envelope system created by using the double wall building method can reduce energy use by 35%.

The building envelope system of the present invention can be a cost-neutral, net-zero energy house that meets the goals of the Department of Energy, whereby the costs of constructing the building according to the present invention (as compared to the cost of building conventional modular houses) are similar to the costs for a conventional site-built home, while alternative energy sources (e.g. solar, wind, geothermal, etc.) may be sufficient, owing to the building's thermal efficiency, to produce as much energy as the uses throughout a year.

The building envelope system of the present invention may provide better protection for contents and occupants in the case of tornadoes or hurricanes, due to the stronger double wall construction with adhesive spray foam insulation, with wall brackets securing the two walls together, and bolt anchors securing the walls to the foundation.

The building envelope system of the present invention may provide protection for contents and occupants in the case of wild-fires or fires originating outside the home, particularly when spray foam insulation is used that incorporates a fire retardant.

The building envelope system of the present invention may provide protection for contents and occupants in the event of flooding, at least up to the level of the bottom edge of the windows in the house, such as by sealing/adhesive contact of the spray foam insulation with the foundation, and by sealing the doors to their respective frames.

The building envelope system of the present invention provides enhanced sound proofing due to the spray foam insulation and its thickness and density.

Accordingly, a building method and construction is provided for cost-neutral, net-zero energy homes that are safer in tornadoes, wildfires, and floods. Homes built in accordance with the present invention can cost the same to the homebuyer as conventional site-built homes, while providing a net-zero energy capability house with little or no utility costs when combined with alternative energy sources. Thus, the obstacle of cost may be removed from the decision-making process, in selecting the desired method for new building construction. This invention may further create an increased market for renewable energy products in the solar and wind device industries, for example.

Thus, the present invention provides a building construction that can achieve cost-neutral, net-zero energy houses or other building with its highly efficient thermal insulation properties. This building method can reduce the cost of construction to achieve the cost-neutral goal and also reduces the loss of energy from the house by 35% due to its energy efficient building envelope system. The costs associated with the additional inclusion of high technology materials and appliances, energy management systems, solar and wind power devices, geo-thermal heating and cooling units, and, other such components, are offset by the lower overall cost of the construction method detailed herein, and can produce the result of a cost-neutral, net-zero energy house.

Changes and modifications to the specifically-described embodiments may be carried out without departing from the principles of the present invention, which is intended to be limited only by the scope of the appended claims, as interpreted according to the principles of patent law, including the doctrine of equivalents.

The embodiments of the invention in which an exclusive property is claimed are defined as follows:

1. A method of constructing an improved energy efficiency building, said method comprising:

pre-fabricating a plurality of outer walls, each including a plurality of studs, a footer, and a top plate;

pre-fabricating a plurality of partition walls, each including a plurality of studs, a footer, and a top plate;

pre-fabricating a roof assembly including a plurality of roof trusses;

providing an insulation material;

providing a foundation at a building site, the foundation having an outer perimeter region;

transporting the plurality of outer walls, the plurality of partition walls, the roof assembly, and the insulation material to the building site;

positioning the outer walls so as to be supported by the foundation, at locations spaced inwardly from the outer perimeter region of the foundation, the outer walls defining an outer region of a living area of the building;

positioning the partition walls outwardly of the outer walls so as to be supported at the outer perimeter region of the foundation while forming spaces between the outer walls and the partition walls, wherein the partition walls are in substantially parallel, spaced, and non-coplanar arrangement relative to respective ones of the outer walls;

coupling the plurality of partition walls to respective ones of the outer walls using a plurality of brackets that span the spaces formed between the outer walls and the partition walls;

substantially filling the spaces between the outer walls and the partition walls with the insulation material;

positioning the roof assembly atop the outer walls; and substantially filling at least a lower portion of the roof assembly with the insulation material.

2. The method according to claim 1, further comprising installing electrical wiring or plumbing inside of the outer walls prior to said filling the spaces between the outer walls and the partition walls with the insulation material.

3. The method according to claim 1, further comprising:

providing a flooring structure having an outer perimeter region;

prior to said positioning the plurality of outer walls, positioning the flooring atop the foundation so that the outer perimeter of the flooring structure is spaced inwardly from the outer perimeter region of the foundation; and wherein said positioning the plurality of outer walls comprises positioning the plurality of outer walls atop the outer perimeter region of the flooring structure.

4. The method according to claim 1, wherein said positioning the plurality of partition walls comprises driving a plurality of bolt anchors through the footers of the partition walls and into engagement with the outer perimeter region of the foundation.

5. The method according to claim 1, wherein said substantially filling the spaces between the outer walls and the partition walls with the insulation material comprises spraying a spray foam insulation so as to substantially fill the entirety of spaces within the outer walls and the partition walls, including spaces between the studs of the outer walls and the partition walls, with the spray foam insulation.

6. The method according to claim 5, wherein said spraying the spray foam insulation comprises adhering the spray foam insulation to each of the outer walls and the partition walls to increase the structural strength of the outer walls and the partition walls, to thereby increase the resultant improved energy efficiency building's resistance to damage from tornadoes or hurricanes.

7. The method according to claim 6, wherein said spraying the spray foam insulation comprises further adhering and sealing the spray foam insulation the foundation, so as to improve the resultant improved energy efficiency building's resistance to leakage due to flooding.

8. The method according to claim 1, further comprising:

pre-fabricating a building interior comprising at least one chosen from (i) at least one interior wall, (ii) carpeting, (iii) cabinetry, (iv) an electrical fixture, and (v) a plumbing fixture;

prior to said transporting the plurality of outer walls to the building site, coupling together at least two of the outer walls, the roof assembly, the flooring structure, and the building interior to form a pre-assembled building portion; and wherein said transporting the plurality of outer walls to the building site comprises transporting the pre-assembled building portion to the building site.

9. The method according to claim 1, wherein said providing a foundation at a building site comprises pouring a concrete foundation having a first thickness located inwardly of the outer perimeter region of the foundation, and having a second thickness located at the outer perimeter region of the foundation, wherein the first thickness is greater than the second thickness.

10. The method according to claim 9, wherein the outer walls are load-bearing walls and the partition walls are non-load-bearing walls.

11. A method of constructing an improved energy efficiency building, said method comprising:

pre-fabricating a plurality of outer walls, each including a plurality of generally vertically aligned studs, a footer, and a top plate;

pre-fabricating a roof assembly including a plurality of roof trusses;

providing a flooring structure having an outer perimeter region;

pre-fabricating a building interior comprising at least one chosen from (i) at least one interior wall, (ii) carpeting, (iii) cabinetry, (iv) electrical fixtures, and (v) plumbing fixtures;

coupling together at least two of the outer walls, the roof assembly, the flooring structure, and the building interior to form a pre-assembled building portion;

pre-fabricating a plurality of partition walls, each including a plurality of generally vertically aligned studs, a footer, and a top plate;

providing an insulation material;

providing a foundation at a building site, the foundation having an outer perimeter region;

transporting the pre-assembled building portion, the plurality of partition walls, and the insulation material to the building site;

positioning the pre-assembled building portion atop the foundation so that the outer perimeter region of the flooring structure is spaced inwardly from the outer perimeter region of the foundation, with the outer walls supported atop the flooring structure;

installing electrical wiring or plumbing inside of the outer walls;

positioning the partition walls outwardly of the outer walls so as to be supported at the outer perimeter region of the foundation, substantially parallel to respective ones of the outer walls, while forming spaces between the outer walls and the partition walls, said positioning the plurality of partition walls comprising driving a plurality of mechanical fasteners through the footers of the partition walls and into engagement with the outer perimeter region of the foundation;

coupling the plurality of partition walls to respective ones of the outer walls using a plurality of brackets that span the spaces between the outer walls and the partition walls;

substantially filling the spaces between the outer walls and the partition walls, and substantially filling spaces within the outer walls and the partition walls, with the insulation material; and substantially filling at least a lower portion of the roof assembly, including spaces between the roof trusses, with the insulation material.

12. The method according to claim 11, wherein said providing a foundation at a building site comprises pouring a concrete foundation having a first thickness located inwardly of the outer perimeter region of the foundation, and having a second thickness located at the outer perimeter region of the foundation, wherein the first thickness is greater than the second thickness.

13. The method according to claim 12, wherein the outer walls are load-bearing walls and the partition walls are non-load-bearing walls.

14. The method according to claim 11, wherein said substantially filling the spaces between the outer walls and the partition walls with the insulation material and said substantially filling at least a lower portion of the roof assembly with the insulation material, comprises substantially surrounding the living area of the building with a continuous layer the insulation material.

15. The method according to claim 14, wherein the insulation material comprises a fire-retardant, sound-absorbent, at least semi-rigidly curing, adhesive-type spray foam material.

16. The method according to claim 15, wherein said substantially filling the spaces between the outer walls and the partition walls with the insulation material and said substantially filling at least a lower portion of the roof assembly with the insulation material, comprises spraying the spray foam insulation to thereby adhere the spray foam insulation to each of the outer walls and the partition walls to increase the structural strength of the outer walls and the partition walls, to thereby increase the resultant improved energy efficiency building's resistance to damage from tornadoes or hurricanes.

17. The method according to claim 16, wherein said spraying the spray foam insulation comprises further adhering and sealing the spray foam insulation to the foundation, so as to improve the resultant improved energy efficiency building's resistance to leakage due to flooding.

* * * * *

UNITED STATES PATENT AND TRADEMARK OFFICE

CERTIFICATE OF CORRECTION

PATENT NO. : 8,590,262 B1
APPLICATION NO. : 12/855158
DATED : November 26, 2013
INVENTOR(S) : Mark A. Fluga It is certified that error appears in the above-identified patent and that said Letters Patent is hereby corrected as shown below:

In the Specification

Column 4
Line 31, insert --III-III-- after "line"

Column 6
Line 37, "STYROFOAM" should be --STYROFOAM®--

Signed and Sealed this
Twenty-fourth Day of February, 2015

Michelle K. Lee

Michelle K. Lee
*Deputy Director of the United States Patent and Trademark Office*